US006468623B1

(12) United States Patent
Higgins

(10) Patent No.: US 6,468,623 B1
(45) **Date of Patent: *Oct. 22, 2002**

(54) CUSHIONED BACK CARPET

(75) Inventor: Kenneth B. Higgins, LaGrange, GA (US)

(73) Assignee: Milliken & Company, Spartanburg, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/499,830

(22) Filed: Feb. 8, 2000

Related U.S. Application Data

(60) Continuation of application No. 08/743,376, filed on Nov. 4, 1996, now Pat. No. 6,203,881, which is a continuation of application No. 08/468,707, filed on Jun. 6, 1995, now abandoned, which is a division of application No. 08/205,834, filed on Mar. 3, 1994, now Pat. No. 5,545,276.

(51) Int. Cl.[7] ..... B32B 33/00; B32B 3/02

(52) U.S. Cl. ..... 428/95; 428/96

(58) Field of Search ..... 428/95, 96, 47, 428/48

(56) References Cited

U.S. PATENT DOCUMENTS

| | | | | |
|---|---|---|---|---|
| 1,594,261 | A | 4/1926 | Herschmann | |
| 1,872,846 | A | 8/1932 | Thiele | |
| 3,002,868 | A | 10/1961 | Boivin | |
| 3,014,829 | A | 12/1961 | Curtin | |
| 3,039,907 | A | 6/1962 | Scholl | |
| 3,074,835 | A | 1/1963 | Gordon | |
| 3,120,083 | A | 2/1964 | Dahlberg | |
| 3,123,508 | A | 3/1964 | Waugh | 156/78 |
| 3,238,595 | A | 3/1966 | Schwartz et al. | 28/74 |
| 3,309,259 | A | 3/1967 | Schwarts | 428/97 |
| 3,311,338 | A | 3/1967 | Culley | |
| 3,332,828 | A | 7/1967 | Faria et al. | |
| 3,360,422 | A | 12/1967 | Desch | |
| 3,385,751 | A | 5/1968 | Willard et al. | 428/95 |
| 3,402,094 | A | 9/1968 | Levitch | |

(List continued on next page.)

FOREIGN PATENT DOCUMENTS

| | | |
|---|---|---|
| CA | 769844 | 10/1976 |
| DE | 2 129 055 | 1/1973 |
| DE | 111 658 | 3/1975 |

(List continued on next page.)

OTHER PUBLICATIONS

Bentley Mills Cushion Carpet Tile Brochure having a fax date of Mar. 29, 1993 Applicant's photomicrograph of Bentley Mills product, created at least as early as Apr. 29, 1993 with handwritten identifications just added.

*Primary Examiner*—Cheryl A. Juska
(74) *Attorney, Agent, or Firm*—Terry T. Moyer; Daniel R. Alexander

(57) ABSTRACT

An improved cushioned carpet fabric is provided. The cushioned carpet comprises a primary carpet having a primary base and a plurality of pile-forming yarns projecting outwardly from one side. A layer of reinforcement material is bonded to the primary base on the side opposite the pile forming yarns. The reinforcement layer is adjacent to and embedded in, a cushion layer of a polymer such as a polyurethane. There is preferably no additional adhesive between the cushion layer and the layer of reinforcement material since the primary carpet fabric is mated in-situ to the polyurethane-forming composition without preheating the polyurethane-forming composition. An apparatus and process for forming the cushioned carpet fabric of the present invention are also provided.

35 Claims, 6 Drawing Sheets

U.S. PATENT DOCUMENTS

| | | | | | |
|---|---|---|---|---|---|
| 3,519,526 | A | | 7/1970 | Carey et al. | 156/79 |
| 3,537,946 | A | | 11/1970 | Truax et al. | 161/66 |
| 3,560,284 | A | | 2/1971 | Wisotsky et al. | |
| 3,576,706 | A | | 4/1971 | Baumann et al. | |
| 3,664,863 | A | | 5/1972 | Dijkhuizen et al. | 117/161 KP |
| 3,695,987 | A | | 10/1972 | Wisotsky et al. | |
| 3,704,197 | A | | 11/1972 | Bahlo | 428/97 |
| 3,733,239 | A | | 5/1973 | George | |
| 3,804,699 | A | | 4/1974 | Johnson | |
| 3,847,647 | A | | 11/1974 | Bahlo | 428/355 |
| 3,853,680 | A | | 12/1974 | Daniel | |
| 3,887,500 | A | | 6/1975 | Prokai et al. | 260/2.5 AH |
| 3,887,738 | A | | 6/1975 | Taft et al. | 428/95 |
| 3,922,454 | A | | 11/1975 | Roecker | |
| 3,926,700 | A | | 12/1975 | Hopkins, Jr. et al. | 428/95 |
| 3,982,051 | A | | 9/1976 | Taft et al. | 427/207 |
| 4,010,301 | A | | 3/1977 | Anderson et al. | |
| 4,010,302 | A | | 3/1977 | Anderson et al. | |
| 4,015,041 | A | | 3/1977 | Koschatzky et al. | |
| 4,017,656 | A | | 4/1977 | Lasman et al. | |
| 4,022,941 | A | | 5/1977 | Prokai et al. | 427/358 |
| 4,062,993 | A | | 12/1977 | Seward | |
| 4,075,377 | A | | 2/1978 | Aichison et al. | |
| 4,076,878 | A | | 2/1978 | Norby | |
| 4,096,303 | A | | 6/1978 | Doerfling | 428/97 |
| 4,132,817 | A | | 1/1979 | Tillotson | 427/244 |
| 4,171,395 | A | | 10/1979 | Tillotson | 428/95 |
| 4,172,917 | A | | 10/1979 | Angelle et al. | |
| 4,242,394 | A | | 12/1980 | Leib et al. | |
| 4,258,098 | A | * | 3/1981 | Bondoc et al. | 156/331.3 |
| 4,268,551 | A | | 5/1981 | Moore, Jr. | |
| 4,286,003 | A | | 8/1981 | Higgins et al. | 428/95 |
| 4,397,900 | A | | 8/1983 | Higgins | |
| 4,405,393 | A | | 9/1983 | Tillotson | 156/78 |
| 4,482,593 | A | | 11/1984 | Sagel et al. | |
| 4,483,894 | A | | 11/1984 | Porter et al. | 428/95 |
| 4,512,831 | A | | 4/1985 | Tillotson | 156/78 |
| 4,522,857 | A | | 6/1985 | Higgins | 428/95 |
| 4,557,774 | A | | 12/1985 | Hoopengardner | 428/198 |
| 4,576,665 | A | | 3/1986 | Machell | 156/72 |
| 4,647,484 | A | | 3/1987 | Higgins | 428/40 |
| 4,661,380 | A | | 4/1987 | Tillotson | 428/207.1 |
| 4,678,694 | A | | 7/1987 | Claessen | 428/95 |
| 4,689,256 | A | | 8/1987 | Slosberg et al. | 428/95 |
| 4,696,849 | A | | 9/1987 | Mobley et al. | 428/95 |
| 4,702,950 | A | | 10/1987 | Slosberg et al. | 428/95 |
| 4,770,916 | A | | 9/1988 | Leukel et al. | 428/95 |
| 4,797,170 | A | | 1/1989 | Hoopengardner | 428/354 |
| 4,798,644 | A | | 1/1989 | Scott et al. | 156/324 |
| 4,822,658 | A | | 4/1989 | Pacione | 428/95 |
| 4,824,498 | A | | 4/1989 | Goodwin et al. | 156/71 |
| 4,842,915 | A | | 6/1989 | Hartmann et al. | 418/95 |
| 4,853,280 | A | * | 8/1989 | Poteet | 428/105 |
| 4,865,688 | A | | 9/1989 | Cross et al. | 156/78 |
| 4,871,603 | A | | 10/1989 | Malone | 428/300 |
| 4,877,669 | A | | 10/1989 | Endrenyi, Jr. et al. | 428/95 |
| 4,915,999 | A | | 4/1990 | Tillotson | |
| 5,030,497 | A | | 7/1991 | Claessen | 428/95 |
| 5,045,375 | A | | 9/1991 | Davis et al. | 428/97 |
| 5,077,874 | A | | 1/1992 | Trask et al. | 28/115 |
| 5,096,764 | A | | 3/1992 | Terry et al. | 428/95 |
| 5,104,693 | A | | 4/1992 | Jenkines | |
| 5,198,277 | A | | 3/1993 | Hamilton et al. | 428/97 |
| 5,204,155 | A | | 4/1993 | Bell et al. | 428/95 |
| 5,540,968 | A | | 7/1996 | Higgins | 428/95 |
| 5,545,276 | A | | 8/1996 | Higgins | 156/79 |
| 5,948,500 | A | | 9/1999 | Higgins | 428/95 |
| 6,203,881 | B1 | | 3/2001 | Higgins | 428/95 |

FOREIGN PATENT DOCUMENTS

| | | |
|---|---|---|
| DE | 25 44 033 | 4/1977 |
| DE | 25 57 719 | 6/1977 |
| EP | 0268875 | 6/1988 |
| FR | 1440797 | 4/1966 |
| GB | 465518 | 5/1937 |
| GB | 971958 | 10/1964 |
| GB | 1050293 | 12/1966 |
| GB | 1195624 | 6/1970 |
| GB | 1273554 | 5/1972 |
| GB | 1289921 | 7/1972 |
| GB | 2 256 614 | 12/1992 |
| JP | 50-22317 | 6/1973 |
| JP | 48-88732 | 11/1973 |
| JP | 55-143083 | 11/1980 |
| JP | 55-148519 | 11/1980 |
| JP | 56-148531 | 11/1981 |
| JP | 58-138416 | 12/1982 |
| JP | 58-121922 | 7/1983 |
| JP | JO 1-247654 | 3/1988 |
| WO | WO 87/01656 | 3/1987 |
| WO | 93/08325 | 4/1993 |

* cited by examiner

CUSHIONED BACK CARPET

This application is a continuation of Ser. No. 08/743,376, filed on Nov. 4, 1996 and now U.S. Pat. No. 6,203,881, which is a continuation of Ser. No. 08/468,707, filed on Jun. 6, 1995 and now abandoned, which is a divisional of Ser. No. 08/205,834, filed on Mar. 3, 1994 and having issued on Aug. 13, 1996 as U.S. Pat. No. 5,545,276.

FIELD OF THE INVENTION

The present invention relates to cushion backed carpet and more particularly to carpet having a polymer backing preferably formed from a polyurethane-forming composition which is mated to a primary carpet fabric in an in-situ manner without pre-curing the polyurethane-forming composition. A process and apparatus for forming the cushion backed carpet of the present invention are also provided.

BACKGROUND OF THE INVENTION

Carpet and carpet tiles having cushioned backings are well known to those of skill in the art. Such cushioned backed carpet is disclosed, for example in my U.S. Pat. No. 4,522,857 (incorporated by reference). An example of a prior art tufted carpet product is illustrated in FIG. 1A and an example of a prior art bonded carpet product is illustrated in FIG. 1B herein.

In the prior art tufted carpet, a primary carpet fabric 12 is embedded in an adhesive layer 16 in which is embedded a layer of glass scrim or nonwoven material. A foam base composite 19 is likewise adhesively bonded to the adhesive layer 16. In the prior art tufted carpet illustrated in FIG. 1A, the primary carpet fabric 12 includes a loop pile layer 20 tufted through a primary backing 22 by a conventional tufting process and held in place by a precoat backing layer of latex 24 or other appropriate adhesive including a hot melt adhesive or the like. The foam base composite 19 of the prior art tufted carpet product preferably includes an intermediate layer 26 molded to a layer of urethane foam 28 as illustrated.

The bonded carpet product (FIG. 1B) formed according to the prior art employs the same type of foam base composite 19 adhesively bonded by adhesive laminate layers 16. However, the primary carpet fabric 12 has somewhat different components from that of the tufted product in that it preferably comprises cut pile yarns 34 implanted in a PVC, latex, or hot melt adhesive 36 having a woven or nonwoven reinforcement or substrate layer 38 of fiberglass, nylon, polypropylene or polyester.

The practice utilized in forming the product disclosed in my '857 patent and other known products involves preforming and curing the foam base composite 19 of urethane foam and backing material by practices such as are disclosed in U.S. Pat. Nos. 4,171,395, 4,132,817 and 4,512,831, to Tillotson (all incorporated by reference). In the present practice, only after this foam base composite is formed and cured to some degree as a modular component, is it laminated to the carpet base.

As will be appreciated, the cost associated with such modular formation and assembly practices may be reduced by a simplified operation in which a primary carpet fabric, either with or without a stabilizing layer of scrim or the like, is laid directly into a polyurethane-forming composition and thereafter curing the polyurethane. The process can be made even more efficient if the polyurethane-forming composition requires no pre-curing prior to joining the carpet base.

Prior to the present invention, the known processes directed to the application of the polyurethane cushioned backings to fabric substrates have relied on the extremely close control of temperature in both the polyurethane composition and the adjoined fabric layer to effect stability through pre-cure of the polyurethane prior to lamination of the primary carpet to form a composite structure. Such pre-cure has been largely considered necessary in order to yield a stable foam structure to which the primary carpet backing could be applied. The application of heat to the polyurethane composition prior to joinder of the heated fabric backing causes polymer cross linking which has heretofore been thought to be necessary to stabilize the foam mixture to a sufficient degree to prevent the collapse of the foam.

The present invention also provides a particularly simple composite structure amendable to in-situ formation of a stable cushion carpet composite which is not believed to have been previously utilized. Specifically, it has not been previously recognized that a single process could be used to bring all the layers of the cushioned carpet composite together by laying a primary carpet fabric, either with or without some degree of preheat, directly into a mechanically frothed polyurethane-forming composition prior to curing the polyurethane and without an intermediate layer of material.

As indicated, the prior art carpet forming processes typically require the separate formation of a foam base composite comprising a backing layer and a layer of urethane foam. The backing layer is then used as an intermediate layer to which a primary carpet fabric and reinforcing layer can be adhesively bonded.

In the potentially preferred practice of the present invention, the base of the primary carpet fabric is adhesively bonded to a layer of non-woven glass reinforcement material to form a preliminary composite. A puddle of polyurethane-forming composition is simultaneously deposited across a nonwoven backing material. The preliminary composite and the polyurethane-forming composition are thereafter almost immediately brought together with the preliminary composite being laid into, and supported by, the polyurethane-forming puddle. The entire structure is then heated to cure the polyurethane forming composition. The preliminary composite may be slightly heated to about 120° F. to improve heating efficiency although the process may likewise be carried out without such preheating.

It is to be understood that, as with the prior art products, wherein the primary carpet fabric 12 may have different embodiments, the component structure of the primary carpet fabric is not critical to the present invention. Rather it is intended that any primary carpet fabric having a pile-forming portion and a primary base may be utilized as the primary carpet fabric. By "primary base" is meant any single layer or composite structure including, inter alia, the commonly used layered composite of primary backing 22 and latex precoat 24 previously described in relation to the prior art tufted product (FIG. 1A) and the adhesive layer 36 with reinforcement substrate 38 previously described in relation to the prior art bonded product (FIG. 1B). As will be appreciated, the use of polyester in the primary base structure may be desirable due to the eventual heat curing such structure may undergo. Other embodiments as may occur to those of skill in the art may, of course, also be utilized. For example, in the bonded product, the pile forming yarns could be heat tacked to the substrate 38 as disclosed in my copending Application No. 08/091,309 now U.S. Pat. No. 5,443,881 to permit simplified construction of a primary carpet.

OBJECTS AND SUMMARY OF THE PRESENT INVENTION

In view of the foregoing it is a general object of the present invention to provide a carpet including a foam cushioned backing formed in-situ.

In that respect, it is an object of the present invention to provide a cushioned carpet composite wherein a reinforcement layer is disposed, at least partially, within a polymer mass which is adjacent a primary carpet with such primary carpet being laid in-situ into a puddle of the polymer without a pre-curing operation.

It is a related object of the present invention to provide a cushioned carpet composite wherein a primary carpet fabric is joined to a reinforcement layer and laid in-situ into a polyurethane-forming composition which has not undergone a pre-cure operation.

It is a further related object of the present invention to provide a continuous process for the in-situ formation of a cushioned carpet composite wherein a reinforcement layer is adhered to the base of a primary carpet fabric simultaneously with the application of a polyurethane-forming composition to a nonwoven backing layer and the primary carpet fabric with the adhered reinforcement layer is laid into the polyurethane-forming composition prior to curing the polyurethane-forming composition to form the carpet composite.

It is still a further related object of the present invention to provide a continuous process for the in-situ formation of a cushioned carpet composite wherein a reinforcement layer is adhered between a primary carpet base and a backing layer through the in-situ application of a polyurethane forming composition without the need for an intermediate adhesion step.

It is still a further related object of the present invention to provide an apparatus for carrying out the continuous in-situ formation of a cushioned carpet composite.

Accordingly, it is a feature of the present invention to provide a cushioned carpet composite including a primary carpet fabric in laminar relation to a reinforcement layer wherein such reinforcement layer is at least partially embedded in a polyurethane foam layer which is disposed adjacent to a nonwoven backing layer. The reinforcement layer may be bonded to the base of the primary carpet fabric by the polyurethane foam or by a separate adhesive.

It is a further feature of the present invention to provide a process for forming a cushioned carpet composite including the simultaneous continuous steps of adhering a woven or non-woven reinforcement material to the base of a primary carpet fabric; depositing a puddle of a polyurethane-forming composition across a backing layer or support structure and laying the primary carpet fabric and adhered reinforcement material into the puddle of polyurethane-forming composition deposited on the backing layer.

It is a subsidiary feature of the present invention to provide a single step process for forming a cushioned carpet composite including applying a polyurethane-forming composition adjacent a primary carpet fabric and a nonwoven backing layer with the polyurethane-forming composition at least partially holding an intermediate layer of reinforcement material.

It is yet a further feature of the present invention to provide an apparatus for use in the continuous in-situ formation of a cushioned carpet composite wherein the apparatus includes a polymer application unit for depositing a polyurethane-forming composition or other suitable polymer in combination with an adhesive application apparatus for adhering a reinforcement layer to the base of a primary carpet fabric. The polymer application unit and the adhesive application unit being simultaneously operable in controlled relation to one another such that the primary carpet with the adhered reinforcement layer may be laid directly into the polymer.

In accordance with one aspect of the present invention, a cushioned carpet is provided. The cushioned carpet comprises a primary carpet having a primary base and a plurality of pile-forming yarns projecting outwardly from one side. A layer of reinforcement material is bonded to the primary base on the side away from the pile-forming yarns. The reinforcement material is adjacent to, and embedded at least partially in, a cushion layer of polymer such as polyurethane. There is preferably no additional adhesive between the cushion layer and the layer of reinforcement material. An optional backing material is preferably disposed on the underside of the cushion layer. The backing material may include an adhesive backing on the side away from the cushion layer.

In accordance with another aspect of the present invention, a process for making a cushioned carpet is provided. The process involves obtaining a primary carpet fabric comprising a plurality of pile-forming yarns extending outwardly from one side of a primary base. A layer of reinforcement material is adhered to the primary carpet fabric on the side from which the pile-forming yarns do not extend, thereby forming a preliminary composite. A puddle of polymer such as a polyurethane-forming composition is applied to one side of a backing material and preferably doctored to desired thickness. The preliminary composite is then laid into the puddle of polymer without curing. Following this mating operation the polymer is preferably heat cured and the carpet is cut into tiles.

In accordance with still another aspect of the present invention, an apparatus for use in forming a cushioned carpet composite is provided, comprising: a reinforcement bonding unit for bonding a layer of reinforcement material to the underside of a primary carpet fabric to form a preliminary carpet composite; a polymer application unit for dispersing a polyurethane-forming composition across the surface of a carrier fabric; a mating unit for laying said preliminary carpet composite into said polyurethane-forming composition; and means for heat curing the polyurethane-forming composition subsequent to said preliminary composite being laid into said polyurethane-forming composition; wherein said reinforcement bonding unit, said polymer application and said mating unit are operable in a continuous, simultaneous manner.

While the invention will be described and disclosed in connection with certain preferred embodiments and procedures, it is by no means intended to limit the invention to such specific embodiments and procedures. Rather it is intended to cover all such alternative embodiments, procedures, and modifications thereto as may fall within the true spirit and scope of the invention as defined and limited only by the appended claims.

DETAILED DESCRIPTION

Figure 1A:
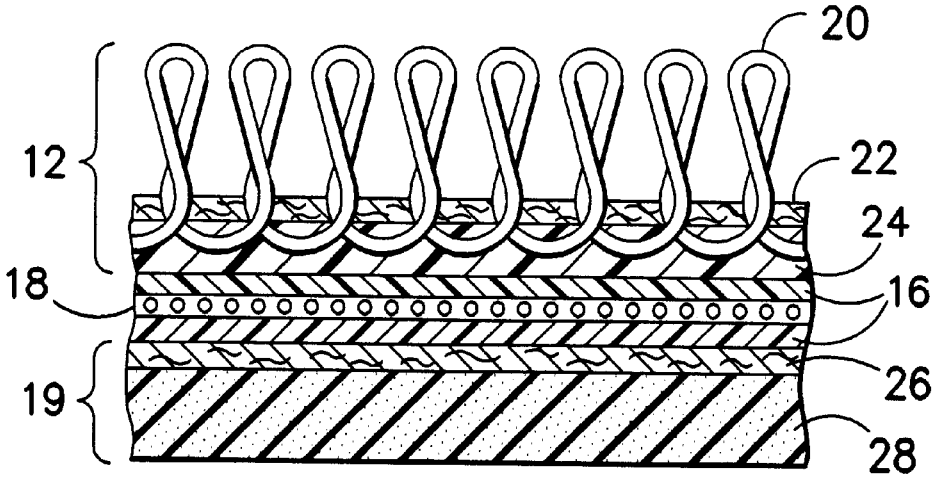
FIG. -1A- PRIOR ART
FIG. 1A is a cut-away view of a prior art tufted carpet with a cushioned composite structure.
Figure 1B:
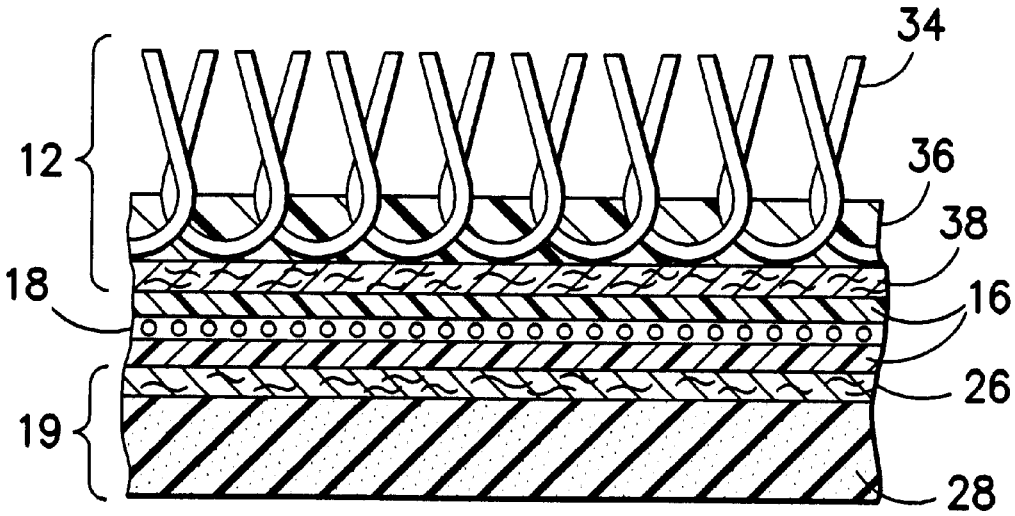
FIG. -1B- PRIOR ART
FIG. 1B is a cut-away side view of a prior art bonded carpet incorporating a cushioned composite structure.
Figure 2:
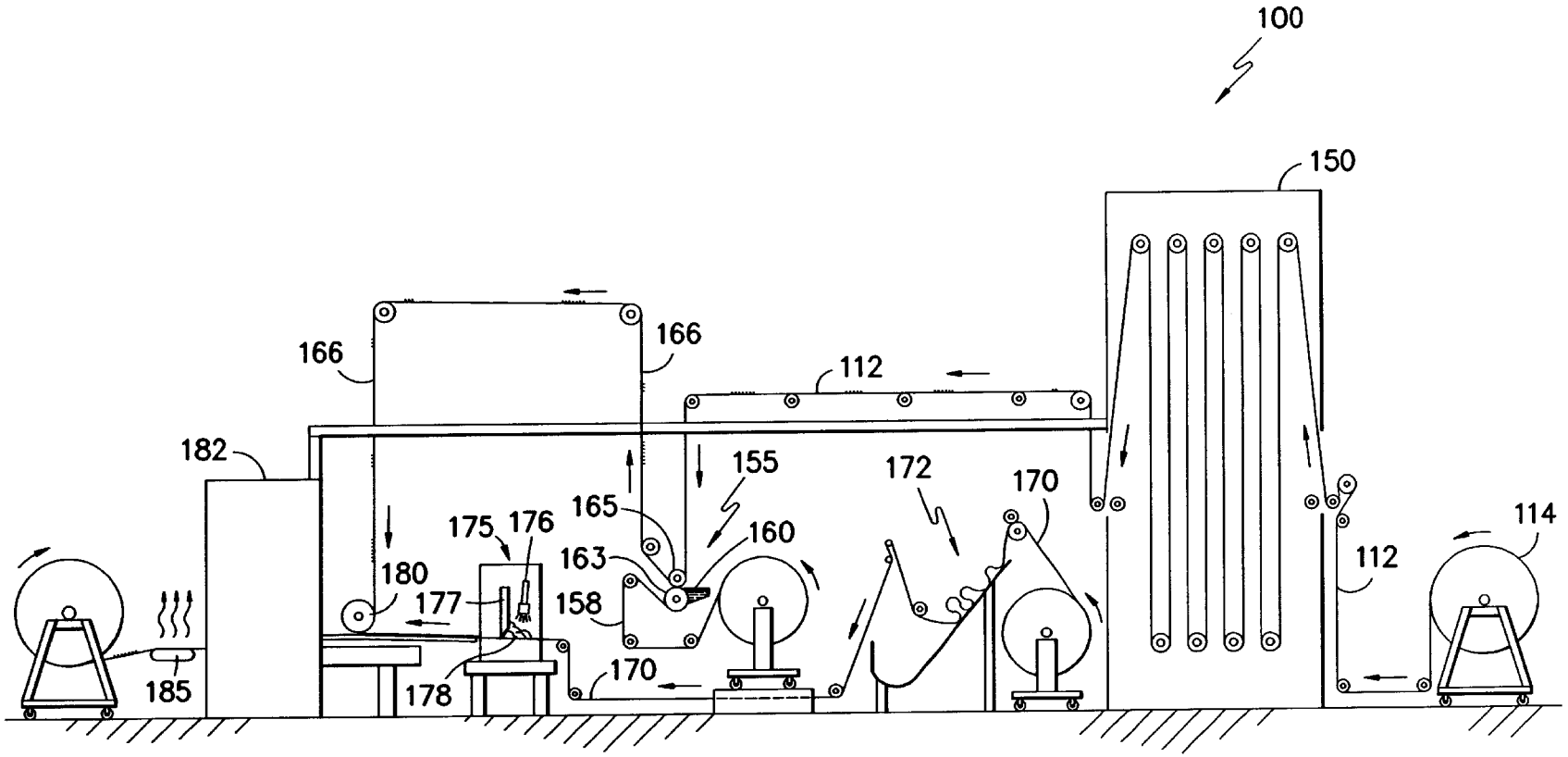
FIG. 2 is a schematic view illustrating a potentially preferred embodiment of the apparatus and process of the present invention.

A schematic view illustrating a potentially preferred apparatus and process used in forming the cushioned carpet of the present invention is illustrated in FIG. 2. The apparatus is designated generally by reference numeral 100. As illustrated, a primary carpet fabric 112 which may incorporate either a tufted or a bonded configuration as described above is drawn from a mounted carpet roll 114. As indicated previously, the primary carpet fabric 112 preferably includes a plurality of pile-forming yarns projecting outwardly from one side of a primary base. If the primary carpet 112 used in the present invention is a tufted carpet, its configuration will preferably conform to that of the primary carpet 12 illustrated in regard to the prior art in FIG. 1A, while if the primary carpet 112 used in the present invention is a bonded product, its configuration will preferably be that of the primary carpet 12 illustrated in FIG. 1B.

Alternative embodiments including those disclosed in U.S. Pat. No. 4,576,665 to Machell (incorporated by reference) may likewise be utilized. For example, it is contemplated that specialized primary backings such as nonwoven structures comprising fiberglass sandwiched between layers of polyester may be utilized in the primary tufted carpet to impart the desired properties relating to stability thereby potentially reducing or even eliminating the need for the latex pre-coat presently utilized. Moreover, it is contemplated that if a precoat is to be utilized, it may be added directly in-line in an operation prior to any adhesive operation.

Figure 3A:
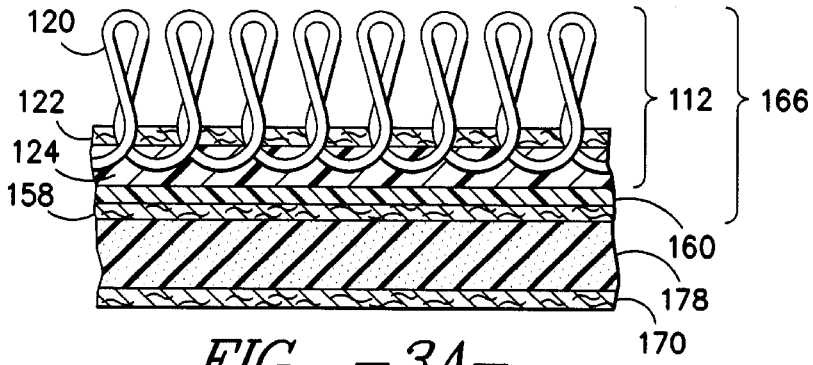
FIG. 3A is a cut-away side view of a tufted carpet incorporating a potentially preferred structure formed by the apparatus and process of the present invention as illustrated in FIG. 2.

With regard to the presently preferred embodiment, in the tufted carpet of the present invention (FIG. 3A), the primary carpet fabric 112 preferably comprises a loop pile layer 120 of pile-forming yarns tufted into a primary backing 122 as is well known and held in place by a precoat of latex or a hot melt adhesive 124. It is contemplated that the latex or hot melt adhesive may be added in-line after removal from the carpet roll prior to the application of any other adhesive as described below. The carpet may be steamed after addition of the precoat to facilitate subsequent printing operations if desired to reduce stresses.

Figure 3B:
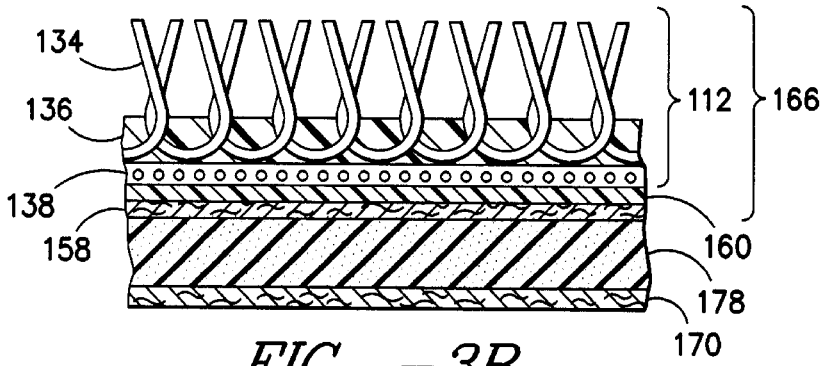
FIG. 3B is a cut-away side view of a bonded carpet incorporating a potentially preferred structure formed by the apparatus and process of the present invention as illustrated in FIG. 2.

In the bonded carpet of the present invention (FIG. 3B), the primary carpet fabric 112 preferably comprises a plurality of cut pile yarns 134 implanted in a latex or hot melt adhesive 136 which is laminated to a reinforcement or substrate layer 138 of a woven or nonwoven material including fiberglass, nylon, polyester or polypropylene. It is contemplated that this substrate layer 138 may be precoated with latex or other thermoplastic polymers to permit melting adhesion with the cut pile yarns 134 upon the application of heat, thereby potentially reducing or eliminating the need for the latex or hot melt adhesive 136.

The yarns 120, 134 may be either spun or filament yarns and are preferably formed from a polyamide polymer such as nylon 6 or nylon 6, 6 available from DuPont Fibers in Wilmington, Del., although other suitable natural or synthetic yarns may likewise be employed as will be recognized by those of skill in the art. By way of example only and not limitation, other materials which might be used include polyesters such as polyethylene terephthalate (PET), and polybutylene terephthalate (PBT); polyolefins, such as polyethylene and polypropylene; rayon; and polyvinyl polymers such as polyacrylonitrile.

In the tufted product, the adhesive pre-coat 124 is preferably SBR latex but other suitable materials such as PVC, EVA, acrylic, and hot melt adhesives as are well known to those of skill in the art may likewise be utilized. In the event that a hot melt adhesive is utilized, it is contemplated that a reinforcement material such as a glass scrim could be directly attached to form a composite laminate without the use of adhesives. Moreover, as previously indicated, it is contemplated that the adhesive pre-coat 124 may be entirely eliminated in the tufted product if the loop pile 120 is tufted in suitably stable relation to the primary backing 122.

Referring again to FIG. 2, in the potentially preferred practice the primary carpet fabric 112 is conveyed by means of a plurality of rolls through an accumulator 150 as is well known in the art to a reinforcement bonding unit 155. Simultaneously with the conveyance of the primary carpet fabric 112 to the reinforcement bonding unit 155, a sheet of reinforcement material 158 is likewise conveyed to the reinforcement bonding unit 155. The reinforcement material 158 is preferably fiberglass nonwoven material although alternative materials may include woven glass, woven polyester, nonwoven glass, and nonwoven polyester.

At the reinforcement bonding unit 155, an adhesive 160 (FIGS. 3A, 3B) such as a hot melt adhesive is preferably applied to the reinforcement material 158 by means of a film coater or other such unit as are well known. The reinforcement material 158 and the primary carpet fabric 112 are thereafter preferably passed in mating relation between joining members such as rolls 163, 165, thereby bonding the reinforcement material 158 to the underside of the primary carpet fabric 112. That is, the reinforcement material 158 is bonded on the side of the primary carpet fabric 112 from which the pile forming yarns do not project. The bonding of the reinforcement material 158 to the underside of the primary carpet fabric produces a preliminary composite 166 which is thereafter laid into a puddle of a polyurethane-forming composition as described below. As stated in U.S. Pat. No. 4,522,857, the adhesive is a layer with a thickness in the range of 0.010"–0.070" and can be a polyolefin, modified polyolefin, polyamide or other suitable thermoplastic material with a weight in the range of 10–70 oz/sq. yd.

Although the reinforcement bonding unit 155 is illustrated in its preferred embodiment as incorporating a film coater, it is to be understood that alternative equivalent means such as application rolls, spray headers and the like may also be utilized. By way of example only, and not limitation alternative means for the application of adhesive 160 are disclosed in U.S. Pat. No. 4,576,665 to Machell.

In the preferred practice, while the preliminary composite 166 is being formed, a backing material 170 such as a nonwoven backing is passed through a scray 172 to a polymer application unit 175 which preferably includes a polymer discharge unit 176 and a doctor blade 177. The backing material 170 is coated with a polymer 178 such as a polyurethane-forming composition as disclosed more fully below.

In the preferred embodiment, the backing material 170 is an 80% polyester, 20% polypropylene nonwoven fibrous material which is available from Spartan Mills Company in Spartanburg, S.C. While this represents the backing material of preference, it is to be understood that any number of alternative compositions may likewise be utilized as dictated by requirements regarding shrinkage and installation. By way of example only, in instances where very little or no shrinkage may be tolerated, the backing material may be up to 100% polyester. Further, while a nonwoven backing material may be preferred, it is contemplated that either woven or non-woven constructions may be utilized as can materials other than the polyester/polypropylene mix such as nylon, fiberglass and the like. The thickness of the backing material 170 can vary in the range of from about 0.01 inches to about 0.19 inches, although a range of between about 0.05 inches and 0.12 inches may be preferred.

As indicated, in the preferred practice the polymer application unit 175 applies a deposit of a polymer 178 (FIGS. 3A, 3B) to the backing material 170 after which the height of the polymer is doctored to a desired level. In the preferred practice, the polymer applied is a polyurethane-forming composition based on a so called soft segment prepolymer of MDI (diphenylmethane diisocyanate) or an MDI derivative. The polyurethane-forming composition also preferably incorporates a silicone surfactant to improve both the frothability and stability of the polyurethane layer or "puddle" which is spread across the surface of the backing material 170. As stated in U.S. Pat. No. 4,522,857, suitable equivalents to polyurethane, such as styrene butadiene latex or PVC, can also be used as the polymer.

The preferred polyurethane-forming composition for use in the present invention is disclosed in U.S. Pat. No. 5,104,693 to Jenkines the teachings of which are incorporated herein by reference. Specifically, the preferred polyurethane-forming composition which is applied across the surface of the carrier backing 170 includes:

(A) At least one isocyanate-reactive material having an average equivalent weight of about 1000 to about 5000;

(B) An effective amount of blowing agent; and (C) A polyisocyanate in an amount to provide an isocyanate index of between about 90 and about 130, wherein at least 30 percent by weight of such polyisocyanate is a soft segment prepolymer reaction product of a stoichiometric excess of diphenylmethane diisocyanate (MDI) or a derivative thereof and an isocyanate-reactive organic polymer having an equivalent weight of from about 500 to about 5,000 and wherein the prepolymer has an NCO content of about 10 to about 30 percent by weight.

The polyurethane-forming composition also preferably contains a silicone surfactant to improve frothability and stability in the form of an organo-silicone polymer such as are disclosed generally in U.S. Pat. No. 4,022,941 to Prokai et al. the teachings of which are incorporated herein by reference. Specifically, the preferred surfactant is preferably a linear siloxane-polyoxyalkylene (AB) block copolymer and specifically a polyalkyleneoxidemethylsiloxane copolymer. One such silicone surfactant which is particularly useful is available under the trade designation L-5614 from OSi Specialties, Inc. whose business address is believed to be 6525 Corners Parkway, Suite 311, Norcross, Ga. 30092.

A sufficient level of the silicone surfactant is used to stabilize the cells of the foaming reaction mixture until curing occurs to allow the preliminary composite 166 to be laid into the uncured polyurethane-forming composition puddle without destabilizing the layer of such polyurethane-forming composition disposed across the surface of the backing material 170. In general, the silicone surfactants are preferably used in amounts ranging from about 0.01 to about 2 parts per hundred parts by weight of component (A) and more preferably from about 0.35 parts to about 1.0 parts by weight of component (A) and most preferably from about 0.4 to 0.75 parts per hundred parts by weight of component (A).

As previously indicated, after disposition of the polymer across the backing material 170 the layer or "puddle" of polymer deposited is preferably doctored to a predetermined height by means of a doctor blade located at the polymer application unit 175. While a simple mechanical doctor blade is preferred, alternative equivalent means such as an air knife or the like may also be used. Such an air knife is disclosed, for example, in U.S. Pat. No. 4,512,831 to Tillotson (incorporated by reference).

In an important aspect of the present invention, the primary carpet fabric 112 which is preferably joined to reinforcement material 158 to form the preliminary composite 166 can be laid directly into the polyurethane-forming composition immediately after it is doctored to the appropriate level without any need to significantly heat either the preliminary composite 166 or the polyurethane-forming composition. Accordingly, the preliminary composite 166 and the backing material 170 with the applied polyurethane-forming composition may be simultaneously delivered at room temperature to a mating roll 180 immediately following the application and doctoring of the polyurethane-forming composition. As will be appreciated, this avoidance of lag time between formation of the components of the cushioned carpet composite permits highly efficient processing readily controllable either manually or by computer control means (not shown) as are well known to those of skill in the art. In the preferred process, the preliminary composite 166 may be slightly preheated to improve operating control during lamination and curing but such preheat is not essential to formation of the desired product.

In the illustrated and preferred embodiment of the carpet, the process described above results in the layer of reinforcement material 158 being laid adjacent to and at least partially embedded in the layer of polyurethane 178. That is, the reinforcement material 158 is preferably in intimate contact with the polyurethane 178 such that the polymer material will hold the reinforcement in place.

Once the preliminary composite 166 has been laid into the polyurethane-forming composition, the resulting composite may be heated in a heating unit 182 by means of conduction, radiant, or convection heaters as are well known in the art. Contact conduction heaters may be preferred. Such heating may be carried out at a temperature of between about 250° F. and about 325° F. for between about 2 minutes and 8 minutes. The resulting foam cushion layer (FIGS. 3A, 3B) which is produced thereby preferably has a density of between about 12 pounds per cubic foot and about 20 pounds per cubit foot and more preferably between about 14 pounds per cubic foot and about 16 pounds per cubic foot.

Following the heat curing operation, the cushioned carpet composite which is formed may be passed over a unidirectional heat source 185 such as a plate heater or roll heater at about 400 ° F. to fuse any outstanding fibers on the backing material 170 into a sooth surface. The carpet composite which is formed will thereafter preferably be cut into carpet tiles almost immediately to avoid any undesired cupping or curl.

Figure 4A:
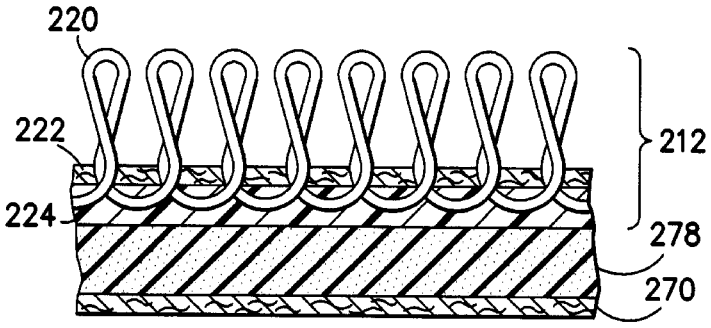
FIG. 4A is a cut-away side view of an alternative embodiment of a tufted carpet having no reinforcement layer.
Figure 4B:
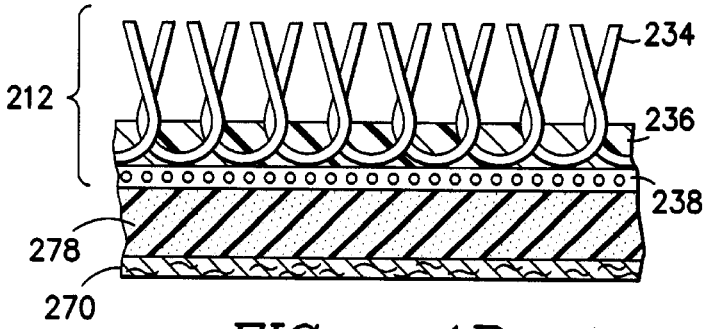
FIG. 4B is a cut-away side view of an alternative embodiment of a bonded carpet having no reinforcement layer.

It will be appreciated that a number of alternative practices may be incorporated into the present invention yielding slightly different products. By way of example only, the reinforcement material 158 may be left completely out of the process thereby making the use of the adhesive application apparatus 155 and adhesive 160 completely unnecessary. In such instances, the primary carpet fabric may be laid directly into the polyurethane-forming composition thereby yielding a composite structure as illustrated in FIGS. 4A and 4B with the polyurethane 278 immediately adjacent to the primary carpet fabric 212.

In yet another potential alternative, the backing 170, 270 may have an adhesive quick release backing attached to the face to which the polyurethane-forming composition is not applied. As will be appreciated, such a quick release backing will permit the carpet to be readily installed and removed without damaging the polyurethane cushion 178, 278. Moreover, it is contemplated that in some instances the backing 170, 270 might be completely eliminated such that the polyurethane cushion 178, 278 would directly contact the flooring as disclosed in relation to my U.S. Pat. No. 4,286,003 which is incorporated herein by reference.

Figure 5:
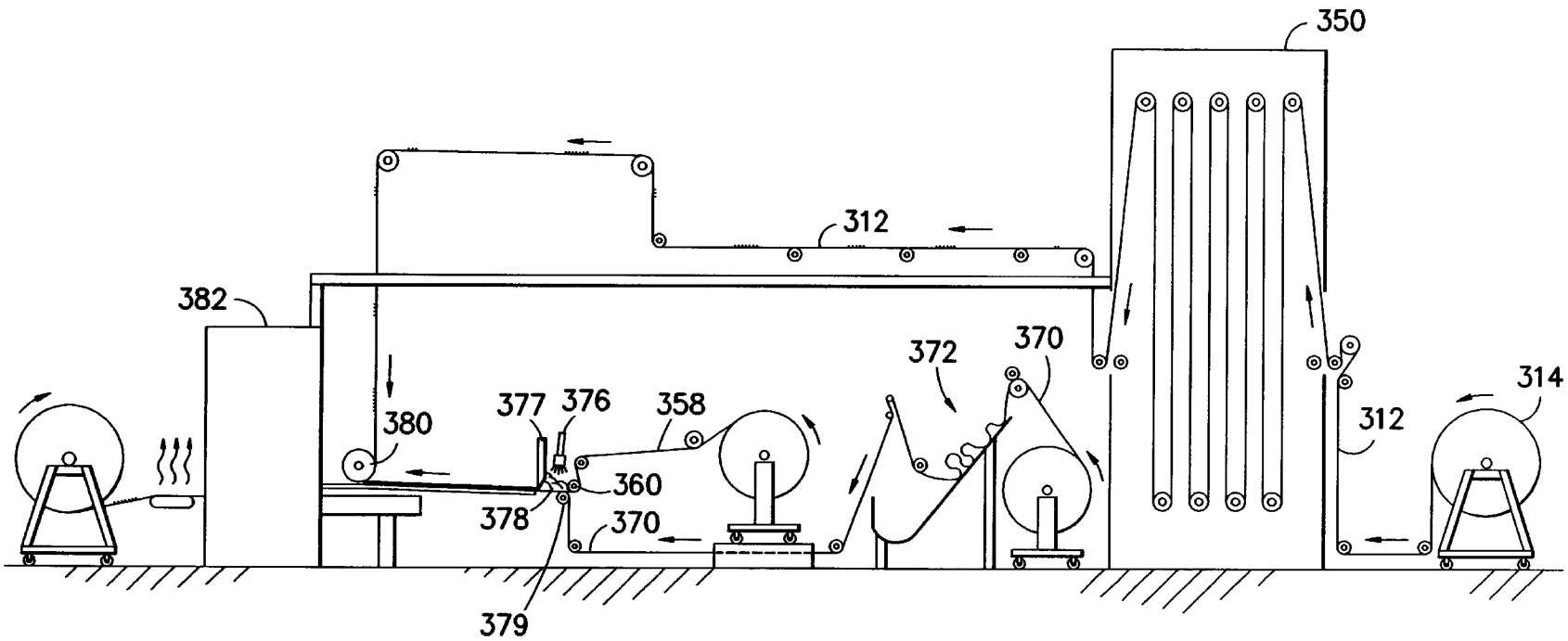
FIG. 5 is a schematic view illustrating an alternative apparatus and process according to the present invention for forming a cushioned carpet composite without separate adhesive bonding between the primary carpet and the reinforcement layer.

An alternative process and apparatus for producing a cushioned carpet composite according to the present invention is shown schematically in FIG. 5. As illustrated, a primary carpet fabric 312 having either a tufted or a bonded configuration is drawn from a mounted carpet roll 314, through an accumulator 350, in the same manner described above. Simultaneously with the delivery of the primary carpet fabric 312 to the mating roll 380, a reinforcement material 358 such as a nonwoven glass is delivered to a polymer contact roll 360 or similar device such as an extrusion coater. The polymer contact roll 360 preferably is in rolling contact with both the surface of the reinforcement material 358 as well as with an accumulation of a polymer 378 such as the polyurethane-forming composition previously described. The polymer contact roll 360 serves to pick up a portion of the polymer 378 and to pass the polymer over and through the reinforcement material 358.

Simultaneously with the passage of polymer through the reinforcement material 358, a backing material 370 such as the nonwoven polyester/polypropylene described above is preferably passed in adjacent mating relation to the polymer-coated reinforcement material 358 between the polymer contact roll 360 and a backing material mating roll 379. A doctor blade 377 serves to control the depth of the polymer which does not pass through the reinforcement material 358 into contact with the backing material 370. Thus, it is to be appreciated that a polymer sandwich structure is formed preferably comprising a layer of backing material 370, a relatively thin layer of polymer 378 such as polyurethane which has been passed through a layer of reinforcement material 358, and a doctored layer of polyurethane 378 which was not passed through the reinforcement material 358. This polymer sandwich structure can thereafter be passed to the mating roll 380 for joinder with the primary carpet fabric 312 by laying the primary carpet fabric 312 directly into the doctored layer of polyurethane 378 without any precuring operation.

Figure 6A:
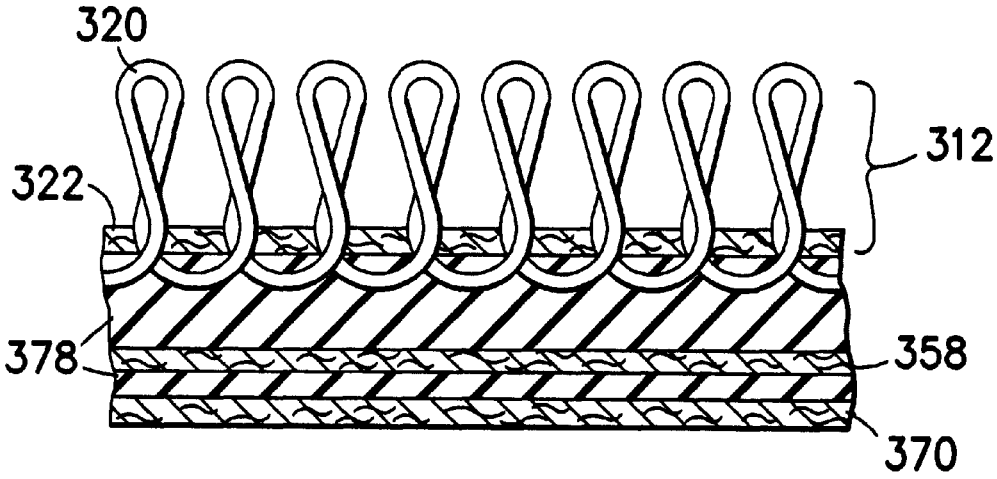
FIG. 6A is a cut-away side view of an alternative structure for a tufted carpet formed by the apparatus and process illustrated in FIG. 5.
Figure 6B:
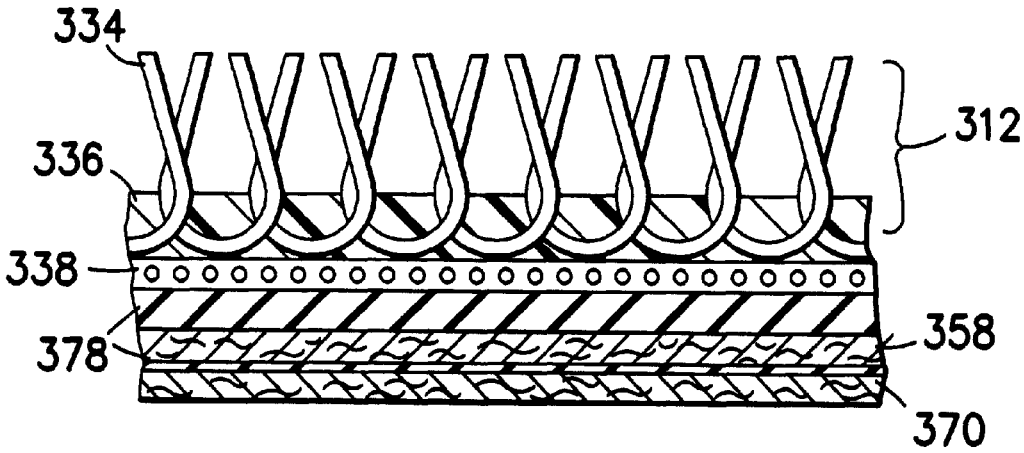
FIG. 6B is a cut-away side view of an alternative structure for a bonded carpet formed by the apparatus and process illustrated in FIG. 5.

A potentially preferred configuration for a resulting tufted carpet composite is illustrated in FIG. 6A. As illustrated, the reinforcement material 358 will be at least partially surrounded by, and embedded in, the polyurethane 378. As illustrated, it is contemplated that the layer of precoat may be eliminated in the tufted structure since the tufts may be held in place by the polyurethane 378. A potentially preferred configuration for a resulting bonded carpet composite is shown in FIG. 6B.

Figure 7:
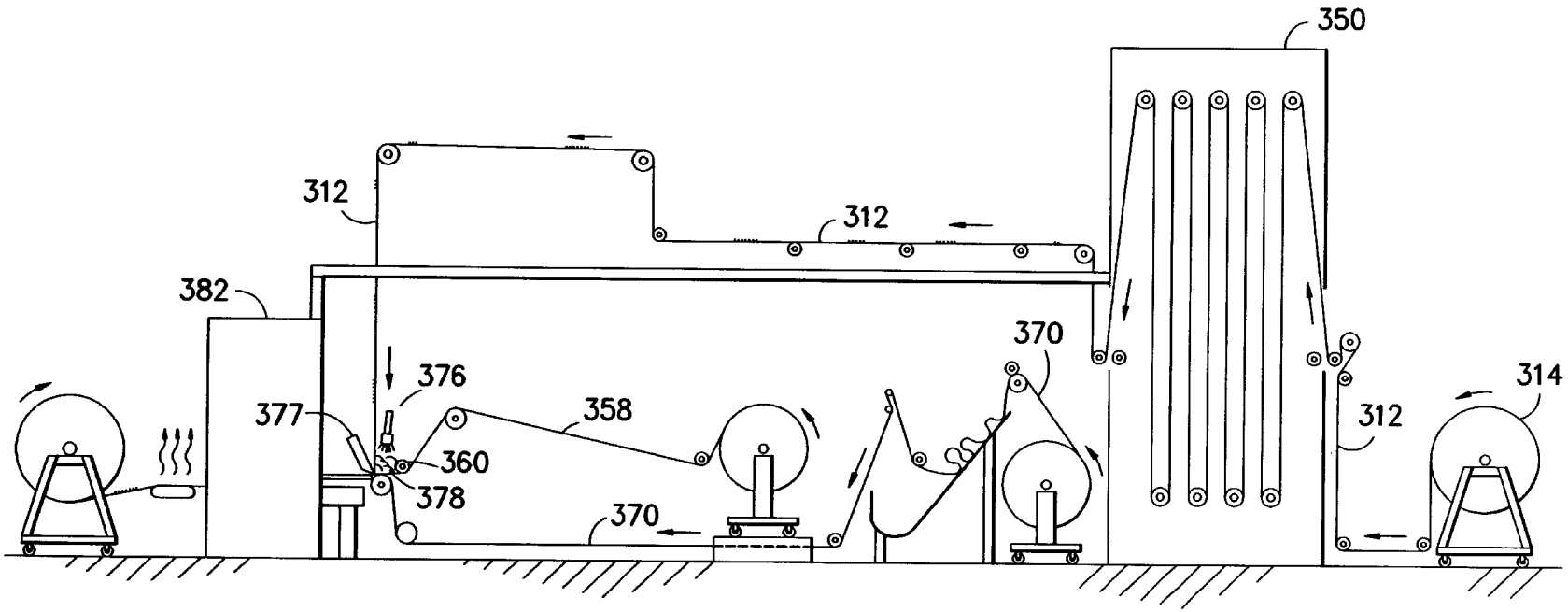
FIG. 7 is a schematic view illustrating yet another alternative apparatus and process according to the present invention for forming a cushioned carpet composite without separate adhesive bonding between the primary carpet and the reinforcement layer as illustrated in FIGS. 6A and 6B.

A further alternative process and apparatus for joining all layers of the cushioned carpet composite is illustrated in FIG. 7. As shown, a layer of reinforcement material 358 is preferably passed adjacent to a polymer contact roll 360 which is in simultaneous rolling contact with both the reinforcement material 358 and a deposit of polymer 378. The polymer contact roll 360 serves to spread a portion of the polymer 378 through the reinforcement material 358 to create a coating on both sides thereof. The reinforcement material 358 with its coating of polymer 378 is then joined in a laminate structure to the primary carpet fabric 312 and a layer of backing material 370 by passage through the nip between the doctor blade 377 and backing material mating roll 379. This practice will yield a bonded carpet composite structure substantially similar to those which are illustrated in FIGS. 6A and 6B.

It is, of course, to be appreciated that while several potentially preferred embodiments have been shown and described, the invention is in no way to be limited thereto, since modifications may be made and other embodiments of the principles of this invention will occur to those skilled in the art to which this invention pertains. Therefore, it is contemplated by the appended claims to cover any such modifications and other embodiments as incorporate the features of this invention within the true spirit and scope thereof.

The invention may be further understood by reference to the following example which is not to be construed as unduly limiting the invention which is to be defined and construed in light of the appended claims.

EXAMPLE

A tufted carpet was produced by the apparatus and process as illustrated and described in relation to FIG. 2. The carpet produced has the configuration illustrated and described in relation to FIG. 3A. The production parameters were as follows:

| | |
|---|---|
| Yarn | 28 Ounces per square yard nylon 6, 6 loop pile continuous filament. |
| Primary Backing | 4 Ounces per square yard nonwoven polyester. |
| Precoat | 14 Ounces per square yard SBR Latex filled with 100 parts $CaCO_2$. |
| Hot Melt Adhesive | 30 Ounces per square yard modified polypropylene. |
| Laminate Reinforcement | 3 Ounces per square yard nonwoven glass with acrylic binder. |
| Urethane Foam Coverage | 32 Ounces per square yard. |
| Urethane Foam Density | 16 Pounds per cubic foot. |
| Backing Material | 4 Ounces per square yard nonwoven (80% polypropylene, 20% polyester). |

What is claimed is:

1. A dimensionally stable cushioned carpet tile suitable for disposition as discrete modular units across a flooring surface, the carpet tile comprising:

(i) a primary carpet fabric having a pile side and an underside with a plurality of pile forming yams projecting outwardly from said pile side;

(ii) an adhesive layer consisting essentially of at least one adhesive extending away from the underside of said primary carpet fabric;

(iii) a layer of stabilizing material in contacting relationship with said adhesive layer such that said layer of stabilizing material is held in place at a fixed position below said primary carpet fabric; and (iv) a foam cushion layer bonded to said layer of stabilizing material with at least a portion of said layer of stabilizing material embedded in said foam cushion layer; said layer of stabilizing material being the only layer of stabilizing material positioned between said foam cushion layer and said primary carpet fabric.

2. The carpet tile according to claim 1, wherein said foam cushion layer comprises a polymer selected from the group consisting of:

polyurethane,

PVC, and styrene butadiene latex.

3. The carpet tile according to claim 1, wherein said foam cushion layer comprises PVC.

4. The carpet tile according to claim 1, wherein said foam cushion layer comprises styrene butadiene latex.

5. The carpet tile according to claim 1, wherein said stabilizing material is glass.

6. The carpet tile according to claim 1, wherein said stabilizing material is polyester.

7. The carpet tile according to claim 1, wherein said primary carpet fabric comprises:

a primary backing;

a pile layer having pile-forming yarns tufted into said primary backing;

and a precoat securing the pile-forming yarns of said pile layer in place relative to said primary backing.

8. The carpet tile according to claim 1, wherein said primary carpet fabric comprises a plurality of pile yarns implanted in a primary carpet adhesive layer which is laminated to a substrate layer.

9. The carpet tile according to claim 2, wherein said primary carpet fabric comprises:

a primary backing;

a loop pile layer having pile-forming yams tufted into said primary backing;

and a precoat securing the pile-forming yarns of said loop pile layer in place relative to said primary backing.

10. The carpet tile according to claim 9, wherein said precoat comprises a hot melt adhesive.

11. The carpet tile according to claim 9, wherein said precoat comprises a latex.

12. The carpet tile according to claim 2, wherein said primary carpet fabric comprises a plurality of cut pile yarns implanted in a primary carpet adhesive layer which is laminated to a substrate layer.

13. The carpet tile according to claim 12, wherein said primary carpet adhesive layer comprises a latex.

14. The carpet tile according to claim 12, wherein said primary carpet adhesive layer comprises a hot melt adhesive.

15. The carpet tile according to claim 12, wherein said primary carpet adhesive layer comprises a thermoplastic polymer.

16. The carpet tile according to claim 2, wherein said adhesive comprises a hot melt adhesive.

17. The carpet tile according to claim 2, wherein said stabilizing material comprises a sheet of nonwoven fiberglass material.

18. The carpet tile according to claim 2, wherein said stabilizing material comprises a material selected from the group consisting of:

woven glass, woven polyester, nonwoven glass, and nonwoven polyester.

19. The carpet tile according to claim 1, wherein said foam cushion layer comprises a polyurethane which comprises:

at least one isocyanate-reactive material having an average equivalent weight of about 1,000 to about 5,000;

a blowing agent; and a polyisocyanate in an amount to provide an isocyanate index of between about 90 and about 130;

wherein at least 30 percent by weight of said polyisocyanate is a soft segment prepolymer reaction product of a stoichiometric excess of diphenylmethane diisocyanate or a derivative thereof, and an isocyanate-reactive organic polymer having an equivalent weight of from about 500 to about 5,000; and wherein the prepolymer has an NCO content of about 10 to about 30 percent by weight.

20. The carpet tile according to claims 18 or 19, wherein said foam cushion layer comprises polyurethane and includes a silicone surfactant.

21. The carpet tile according to claim 20, wherein said silicone surfactant is an organo-silicone polymer.

22. The carpet tile according to claim 20, wherein said silicone surfactant is a linear siloxane-polyoxyalkylene block copolymer.

23. The carpet tile according to claim 22, wherein said linear siloxane-polyoxyalkylene block copolymer comprises a polyalkyleneoxidemethylsiloxane copolymer.

24. The carpet tile according to claim 19, wherein said foam cushion layer further includes a silicone surfactant in the amount of from about 0.01 to about 2 parts per hundred by weight of at least one isocyanate-reactive material.

25. The carpet tile according to claim 19, wherein said foam cushion layer further includes a silicone surfactant in the amount of from about 0.35 to about 1.0 parts per hundred by weight of at least one isocyanate-reactive material.

26. The carpet tile according to claim 19, wherein said foam cushion layer further includes a silicone surfactant in the amount of from about 0.4 to about 0.75 parts per hundred by weight of at least one isocyanate-reactive material.

27. The carpet tile according to claim 17, wherein said foam cushion layer comprises polyurethane.

28. The carpet tile according to claim 27, wherein said sheet of nonwoven fiberglass material has an acrylic binder; and a textile backing material comprising polypropylene and polyester is disposed adjacent to the surface of said polyurethane foam cushion layer facing away from said stabilizing material.

29. The carpet tile according to claims 2 or 27, wherein said adhesive layer comprises an adhesive selected from the group consisting of:

hot melt adhesive, polyolefin, modified polyolefin, and polyamide.

30. The carpet tile according to claim 29, wherein said adhesive layer has a thickness within the range of 0.010" to 0.070".

31. The carpet tile according to claim 29, wherein said adhesive has a weight of from 10–70 oz./sq. yd.

32. The carpet tile according to claim 29, wherein said adhesive has a weight of about 30 oz./sq. yd.

33. The carpet tile according to claim 27, wherein said foam cushion layer comprises a foam having been cured in contact with said sheet of nonwoven fiberglass material, thereby embedding said sheet in and bonding it to said cured foam.

34. The carpet tile according to claim 28, wherein said foam cushion layer comprises a foam having been cured in contact with said sheet of nonwoven fiberglass material, thereby embedding said sheet in and bonding it to said cured foam.

35. The carpet tile according to claim 33, having a textile backing material disposed adjacent to the surface of said polyurethane foam cushion layer facing away from said stabilizing material.

* * * * *